US008451280B2

(12) United States Patent
Ishioka

(10) Patent No.: US 8,451,280 B2
(45) Date of Patent: May 28, 2013

(54) DISPLAY CONTROL DEVICE HAVING A FRAME BUFFER FOR TEMPORARILY STORING IMAGE DATA TO BE DISPLAYED ON EITHER ONE OF A FIRST DISPLAY DEVICE OR A SECOND DISPLAY DEVICE

(75) Inventor: Toshiyuki Ishioka, Osaka (JP)

(73) Assignee: Panasonic Corporation, Osaka (JP)

( * ) Notice: Subject to any disclaimer, the term of this patent is extended or adjusted under 35 U.S.C. 154(b) by 275 days.

(21) Appl. No.: 12/989,501

(22) PCT Filed: Apr. 23, 2009

(86) PCT No.: PCT/JP2009/001872

§ 371 (c)(1),
(2), (4) Date: Oct. 25, 2010

(87) PCT Pub. No.: WO2009/133675

PCT Pub. Date: Nov. 5, 2009

(65) Prior Publication Data

US 2011/0037773 A1 Feb. 17, 2011

(30) Foreign Application Priority Data

Apr. 30, 2008 (JP) ..... 2008-118154

(51) Int. Cl.
*G09G 5/393* (2006.01)
*G09G 5/39* (2006.01)
*G09G 5/395* (2006.01)

(52) U.S. Cl.
USPC ..... 345/531; 345/1.1

(58) Field of Classification Search
USPC ..... 345/545, 1.1
See application file for complete search history.

(56) References Cited

U.S. PATENT DOCUMENTS 4,704,697 A * 11/1987 Kiremidjian et al. ..... 345/568
4,958,378 A * 9/1990 Bell ..... 382/222

(Continued)

FOREIGN PATENT DOCUMENTS

JP 3-29991 2/1991
JP 7-28434 1/1995

(Continued)

OTHER PUBLICATIONS

International Search Report issued Aug. 4, 2009 in International (PCT) Application No. PCT/JP2009/001872.

*Primary Examiner* — James A Thompson
*Assistant Examiner* — Jason Pringle-Parker
(74) *Attorney, Agent, or Firm* — Wenderoth, Lind & Ponack, L.L.P.

(57) ABSTRACT

A display control device (1) comprises: a plurality of display devices (16*a*) and (16*b*); a display output section (18) which supplies image data to the display devices (16*a*) and (16*b*); a frame buffer (22) which temporarily stores the image data; and a buffer control section (24) which controls the frame buffer (22). The display output section (18) transmits the image data stored in the frame buffer (22) to the plurality of display devices (16*a*) and (16*b*), and reads, from an image data storage section (12), image data not stored in the frame buffer (22), so as to transmit the read image data to the display devices (16*a*) and (16*b*), and to write the read image data in the frame buffer (22). The buffer control section (24) is configured to prevent that image data, which are stored in the frame buffer (22) and which are not yet read, are overwritten by the image data read from the image data storage section (12). Thereby, it is possible to reduce the amount of memory access at low cost.

9 Claims, 7 Drawing Sheets

U.S. PATENT DOCUMENTS 5,063,442 A * 11/1991 Hekker et al. ..... 348/61
5,488,385 A * 1/1996 Singhal et al. ..... 345/3.1
5,537,128 A * 7/1996 Keene et al. ..... 345/89
5,579,025 A * 11/1996 Itoh ..... 345/3.2
5,654,742 A * 8/1997 Priem et al. ..... 345/545
5,764,964 A * 6/1998 Dwin et al. ..... 345/546
5,874,928 A * 2/1999 Kou ..... 345/1.1
5,896,116 A * 4/1999 Torizuka et al. ..... 345/87
5,949,437 A * 9/1999 Clark ..... 345/502
6,400,361 B2 * 6/2002 Toffolo ..... 345/213
6,870,518 B1 * 3/2005 Brenner ..... 345/1.3
2001/0046263 A1 * 11/2001 Yamada et al. ..... 375/240.12
2004/0075622 A1 * 4/2004 Shiuan et al. ..... 345/1.1
2005/0280601 A1 * 12/2005 Fukue ..... 345/1.1
2007/0222774 A1 * 9/2007 Foster ..... 345/204

FOREIGN PATENT DOCUMENTS

JP 2005-292677 10/2005
JP 2007-333892 12/2007
WO WO 2004061609 A2 * 7/2004

* cited by examiner

TIMING T

TIMING T + 1

DISPLAY CONTROL DEVICE HAVING A FRAME BUFFER FOR TEMPORARILY STORING IMAGE DATA TO BE DISPLAYED ON EITHER ONE OF A FIRST DISPLAY DEVICE OR A SECOND DISPLAY DEVICE

CROSS REFERENCE TO RELATED APPLICATIONS

This application claims the benefit of priority from Japanese Patent Application No. 2008-118154 filed in Japan on Apr. 30, 2008, the entire content of which is hereby incorporated by reference in the application and claims of the present application.

TECHNICAL FIELD

The present invention relates to a display control device and a display control method for a plurality of display devices.

BACKGROUND ART

Conventionally, a display control device for displaying an image in a display device is known. For example, Japanese Patent Laid-Open No. 2007-333892 discloses an example of a conventional display control device. In the patent document, a basic configuration of the conventional display control device is described as follows.

The display control device writes image data into a buffer at a display image update timing (hereinafter referred to as "update rate") which depends on the image data. Further, the display control device reads, from the buffer, the image data stored in the buffer at a refresh rate (hereinafter referred to as "display rate") of a screen, and outputs the read image data to the display device.

SUMMARY OF THE INVENTION

Problems to be Solved by the Invention

In the above described conventional display control device, when the display rate is higher than the update rate, it is required that, in spite of the fact that the image data are not updated, the display control device repeatedly accesses the buffer so as to read the same image data and outputs the read image data to the display device. Usually, the buffer which stores the image data is an external memory of the display control device. Therefore, there has been a problem that, when the amount of access to the external memory is increased, the processing load of the display control device is increased.

In particular, in recent years, also in portable game machines, portable telephones, and the like, the number of terminals having a plurality of display devices has been increasing. It is expected that the above described increase in the processing load of the display control device becomes remarkable with the increase in the number of display devices.

A configuration is also known in which a frame buffer for temporarily storing the image data is provided in an internal memory of the display control device in order to reduce the amount of access to the external memory, and in which the image data that are not updated are read from the internal memory.

However, in the conventional configuration, the temporary storage frame buffer needs to be provided in correspondence with each of the plurality of display devices. Therefore, the number of frame buffers is increased with the increase in the number of display devices. This results in a problem that the cost of the display control device is increased, because the cost of the internal memory is higher than the cost of the external memory.

The present invention has been made in view of the above described circumstances. An object of the present invention is to provide a display control device which is low cost and in which the amount of access to the memory is reduced.

Means for Solving the Problems

A display control device according to the present invention comprises: a plurality of display devices; a display output section which supplies image data to the display devices; an image data storage section which stores the image data; a temporary storage section which temporarily stores image data read from the image data storage section and which has a smaller number of frame buffers than the number of the display devices; and a buffer control section which controls timings of writing and reading image data to and from the frame buffer. The display control device has a configuration wherein the display output section reads image data from the frame buffer on the basis of a control signal from the buffer control section, so as to transmit the read image data to predetermined display devices among the plurality of display devices, and reads image data to be displayed in the remaining display devices from the image data storage section, so as to transmit the read image data to the remaining display devices, and to write the read image data in the frame buffer on the basis of the control signal from the buffer control section, and wherein the buffer control section prevents that the image data, which are stored in the frame buffer and which are not yet read, are overwritten by the image data read from the image data storage section.

A display control method according to the present invention is based on a display control device which comprises: a plurality of display devices; a display output section which supplies image data to the display devices; an image data storage section which stores the image data; a temporary storage section which temporarily stores image data stored in the image data storage section and which has a smaller number of frame buffers than the number of the display devices; and a buffer control section which controls timing of writing and reading image data to and from the frame buffer. The display control method has a configuration wherein the display output section transmits, to the buffer control section, data representing an image data read position in the frame buffer and data representing an image data write position in the frame buffer, wherein the buffer control section generates, on the basis of the data representing the image data read position and the data representing the image data write position, a control signal for controlling image data read and write timings so as to prevent the image data, which are stored in the frame buffer and which are not yet read, from being overwritten by the image data read from the image data storage section, and to transmit the generated control signal to the display output section, and wherein the display output section reads, on the basis of the control signal transmitted from the buffer control section, image data from the frame buffer, so as to transmit the read image data to predetermined display devices among the plurality of display devices, and reads image data to be displayed in the remaining display devices from the image data storage section, so as to transmit the read image data to the remaining display devices, and to write the read image data in the frame buffer on the basis of the control signal from the buffer control section.

The present invention includes other aspects as will be described below. Therefore, the disclosure of the present invention is intended to provide some of the aspects of the present invention and is not intended to limit the scope of the present invention described and claimed herein.

DETAILED DESCRIPTION OF THE INVENTION

Figure 1:
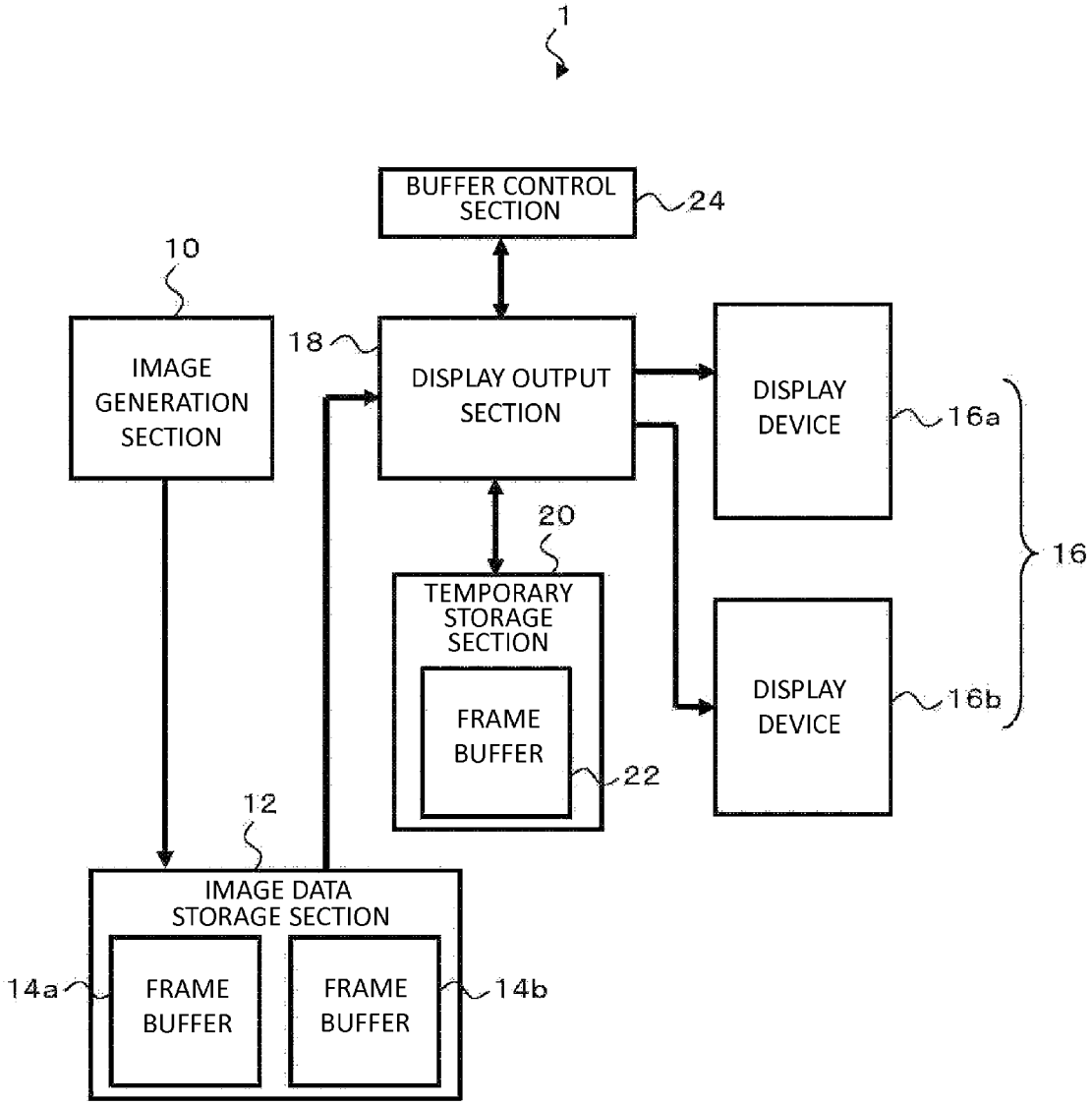
FIG. 1 shows a configuration of a display control device according to a first embodiment.

In the following, the present invention will be described in detail. It is understood that embodiments as will be described below are mere examples of the present invention, and the present invention can be modified into various forms. Therefore, specific configurations and functions, as will be disclosed below, do not limit the scope of the present invention.

A display control device according to the present embodiment comprises: a plurality of display devices; a display output section which supplies image data to the display devices; an image data storage section which stores the image data; a temporary storage section which temporarily stores image data read from the image data storage section and which has a smaller number of frame buffers than the number of the display devices; and a buffer control section which controls timings of writing and reading image data to and from the frame buffer. The display control device has a configuration wherein the display output section reads image data from the frame buffer on the basis of a control signal from the buffer control section, so as to transmit the read image data to predetermined display devices among the display devices, and reads image data to be displayed in the remaining display devices from the image data storage section, so as to transmit the read image data to the remaining display devices, and to write the read image data in the frame buffer on the basis of the control signal from the buffer control section, and wherein the buffer control section prevents that the image data, which are stored in the frame buffer and which are not yet read, are overwritten by the image data read from the image data storage section.

With this configuration, the buffer control section performs control such that the image data, which are stored in the frame buffer and which are not yet read, are prevented from being overwritten by the image data read from the image data storage section, and hence the frame buffer can be commonly used by the plurality of display devices. Thereby, the amount of access to the image data storage section can be reduced by using a smaller number of frame buffers than the number of display devices. As a result, it is possible to respond to the demand to reduce the amount of access to the image data storage section and to reduce the cost.

In the display control device according to the present embodiment, the buffer control section has a configuration wherein the writing and reading of image data to and from the frame buffer are performed in the unit of each of the lines configuring the image data.

With this configuration, it is possible to store new image data in the region corresponding to the read line, and hence it is possible to start storing image data into the frame buffer without waiting until all the image data stored in the frame buffer are read.

In the display control device according to the present embodiment, the buffer control section has a configuration wherein the writing and reading of image data to and from the frame buffer are performed in the unit of each memory access to the frame buffer.

With this configuration, it is possible to store new image data in a unit region of a memory access, from which region image data are read by the memory access, and hence it is possible to start storing image data into the frame buffer without waiting until all the image data stored in the frame buffer are read.

The display control device according to the present embodiment comprises an image data generation section in which image data to be displayed in the plurality of display devices are generated at an update rate lower than the display rate of the display devices, and which stores the generated image in the image data storage section.

With this configuration, it is possible to display the image generated at the update rate lower than the display rate of the display devices while reducing the amount of access to the image data storage section.

In the display control device according to the present embodiment, the display output section has a configuration wherein the latest image data are read from the image data storage section at the timing of the image data generated in the image data generation section, so as to display the read image data in the display device and to store the read image data in the frame buffer, and wherein, when the image data generation timings more than the number of frame buffers overlap each other, image data for the same number of display devices as the number of frame buffers are read from the image data storage section, and image data for the remaining display devices are read at the next display timing.

With this configuration, the image data are read from the image data storage section and displayed in the display device at the timing at which the image data are generated, and hence the latest image data can be displayed. Further, the processing can be suitably performed by the configuration in which, when a plurality of image data generation timings are overlapped each other and thus when the generated image data cannot be stored in the frame buffer, the image data, corresponding to the amount of data that can be stored in the frame buffer, are read from the image data storage section.

The display control device according to the present embodiment has a configuration wherein the image generation section comprises an update rate information acquisition section which acquires information about the update rate used to generate image data, and wherein, when the display output section determines that the update rate of the image data generated in the image generation section is higher than a predetermined threshold value, the display output section outputs the image data to the display device from the image data storage section without storing the image data in the temporary storage section.

With this configuration, the frame buffer is not used for the image data with an update rate higher than the threshold value, and hence it is possible to use the frame buffer to temporarily store the image data with an update rate equal to or lower than the threshold value. When the image data with low update frequency are stored in the frame buffer, it is possible to significantly reduce the number of times of access to the image data storage section.

The display control device according to the present embodiment has a configuration wherein the image generation section comprises the update rate information acquisition section which acquires information about the update rate used to generate image data, and wherein, when the display output section determines that the update rate of the image data generated in the image generation section is lower than the predetermined threshold value, the display output section sets one of the frame buffers as a dedicated frame buffer in which only the image data with the update rate lower than the predetermined threshold value are written.

With this configuration, the image data with low update frequency are stored in the frame buffer, and thereby it is possible to significantly reduce the number of access to the image data storage section.

In the display control device according to the present embodiment, the image generation section has a configuration wherein, when the image generation section generates image data in which a partial region of the preceding frame is updated, the image generation section does not output the generated image data to the image data storage section, but outputs, to the frame buffer, data representing the change in the partial region.

With this configuration, when a partial region of the preceding frame is updated, a part of the image data stored in the frame buffer is updated on the basis of the data representing the change in the partial region, and hence it is possible to display the image different from the preceding frame without access to the image data storage section.

The display control device according to the present embodiment has a configuration wherein the number of the display devices is two, and wherein the number of the frame buffers is one.

With this configuration, when image data to be displayed in the two display devices are alternately stored in the one frame buffer, the amount of access to the image data storage section can be reduced to one half.

An information terminal apparatus according to the present embodiment comprises: a plurality of display devices; a display output section which supplies image data to the display devices; an image data storage section which stores the image data; frame buffers which temporarily stores image data read from the image data storage section and the number of which is smaller than the number of the display devices; and a buffer control section which controls timings of writing and reading image data to and from the frame buffer. The information terminal apparatus has a configuration wherein the display output section reads image data from the frame buffer on the basis of a control signal from the buffer control section, so as to transmit the read image data to predetermined display devices among the plurality of display devices, and reads image data to be displayed in the remaining display devices from the image data storage section, so as to transmit the read image data to the remaining display devices, and to write the read image data in the frame buffer on the basis of the control signal from the buffer control section, and wherein the buffer control section performs control so as to prevent that the image data, which are stored in the frame buffer and which are not yet read, from being overwritten by the image data read from the image data storage section.

With this configuration, similarly to the display control device according to the present embodiment, the amount of access to the image data storage section can be reduced by using a smaller number of frame buffers than the number of display devices. Thereby, it is possible to respond to the demand to reduce the amount of access to the image data storage section and to reduce the cost. Note that the respective configurations of the display control device according to the present embodiment can also be applied to the information terminal apparatus according to the present embodiment.

A display control method according to the present embodiment is based on a display control device which comprises: a plurality of display devices; a display output section which supplies image data to the display devices; an image data storage section which stores the image data; a temporary storage section which temporarily stores image data stored in the image data storage section and which has a smaller number of frame buffers than the number of the display devices; and a buffer control section which controls timings of writing and reading image data to and from the frame buffer. The display control method has a configuration wherein the display output section transmits, to the buffer control section, data representing an image data writing position in the frame buffer and data representing an image data reading position in the frame buffer, wherein the buffer control section generates, on the basis of the data representing the read position and the data representing the write position, a control signal for controlling image data read and write timings so as to prevent the image data, which are stored in the frame buffer and which are not yet read, from being overwritten by the image data read from the image data storage section, and transmits the generated control signal to the display output section, and wherein the display output section reads, on the basis of the control signal transmitted from the buffer control section, image data from the frame buffer, so as to transmit the read image data to predetermined display devices among the plurality of display devices, and reads image data to be displayed in the remaining display devices from the image data storage section, so as to transmit the read image data to the remaining display devices, and to write the read image data in the frame buffer on the basis of the control signal from the buffer control section.

With this configuration, similarly to the display control device according to the present embodiment, the amount of access to the image data storage section can be reduced by using a smaller number of frame buffers than the number of display devices, and thereby it is possible to respond to the demand to reduce the amount of access to the image data storage section and to reduce the cost. Note that the respective configurations of the display control device according to the present embodiment can also be applied to the display control method according to the present embodiment.

In the following, display control devices according to embodiments of the present invention will be described in more detail with reference to the accompanying drawings.

First Embodiment

FIG. 1 is a block diagram showing a configuration of a display control device 1 according to the present embodiment. The display control device 1 comprises an image generation section 10 which generates image data, an image data storage section 12 which stores the image data, two display devices 16*a* and 16*b* (generally referred to as "display device 16") each of which displays an image, a display output section 18 which reads the image data stored in the image data storage section 12, and which displays the read image data in the display device 16, a temporary storage section 20 which temporarily stores the image data read from the image data storage section 12, and a buffer control section 24 which controls timings of writing and reading image data to and from the temporary storage section 20. Note that although the case of two display devices 16 is described in the present embodiment, the number of display devices 16 is not limited to two, and any number of display devices 16 may be used.

The image generation section 10 generates image data to be displayed in the display device 16, and writes the generated image data in the image data storage section 12. The image generation section 10 generates image data at an update rate of 30 fps (frame per second). The image generation section 10 may be configured by a processor or a hard engine.

The image data storage section 12 has frame buffers 14*a* and 14*b* which respectively correspond to the display devices 16*a* and 16*b*. The frame buffer 14*a* stores image data to be displayed in the display device 16*a* while the frame buffer 14*b* stores image data to be displayed in the display device 16*b*. The temporary storage section 20 has a frame buffer 22 which is commonly used by the display device 16*a* and the display device 16*b*. The image data of the display device 16*a* and the display device 16*b* are written in the common frame buffer 22.

Here, the hardware configuring the image data storage section 12 and the temporary storage section 20 will be described. The image data storage section 12 is configured by, for example, an inexpensive external memory (for example, a DRAM) which is separate from a system LSI comprising the display output section 18. On the other hand, the temporary storage section 20 is configured by a memory (for example, an SRAM) in the system LSI, which memory is more expensive than the external memory but has low power consumption per unit access. Therefore, there is a demand to reduce the amount of access to the external memory by using the internal memory as much as possible, while from the viewpoint of cost, there is a demand to reduce the capacity of the internal memory.

The display output section 18 transmits image data to the display device 16 in correspondence with the display rate of the display device 16. In the present embodiment, the display rate of the display device 16 is 60 fps. Therefore, even when the image data are not updated, the display output section 18 is required to transmit the image data to the display device 16 at the rate of 60 times per second. The display output section 18 stores the image data in the frame buffer of the temporary storage section 20 according to a control signal from the buffer control section 24.

The display output section 18 transmits the data representing the image data write position in the frame buffer 22 to the buffer control section 24, and transmits the data representing the image data read position in the frame buffer 22 to the buffer control section 24. Thereby, the buffer control section 24 grasps the data write position and the data read position at the present time. The buffer control section 24 transmits a control signal for controlling data read and data write timings to the display output section 18 on the basis of the data write position and the data read position. This control signal is a signal used to prevent the unread image data from being overwritten. As an example of this control signal, a signal representing whether or not the writing of image data is permitted may be used. On the basis of the control signal from the buffer control section 24, the display output section 18 reads image data from the frame buffer 22, and writes image data in the frame buffer 22. Note that the buffer control section 24 may also be provided in the display output section 18.

Figure 2:
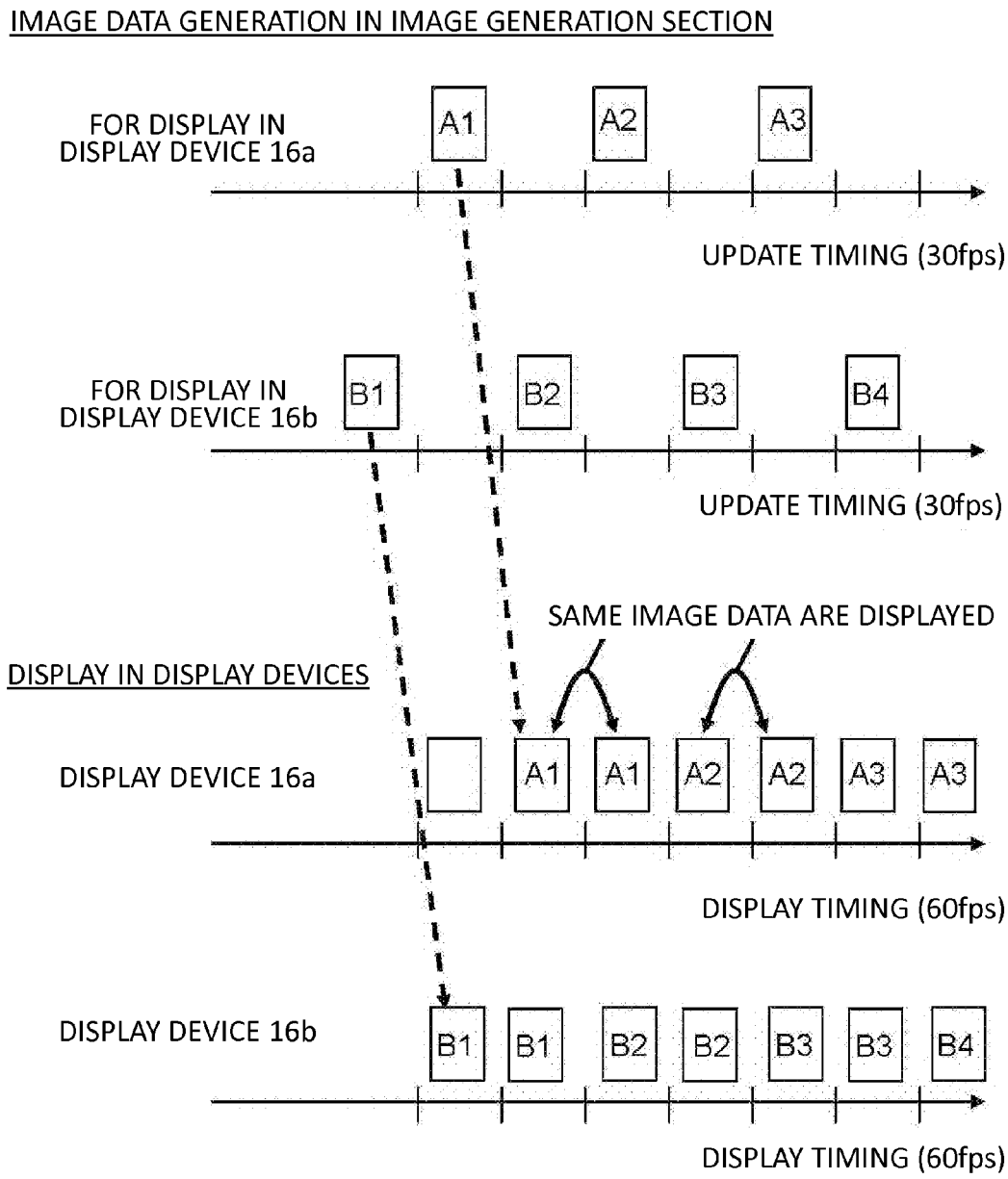
FIG. 2 shows timings at which image data are generated in an image generation section, and timings at which the image data are displayed in display devices.

FIG. 2 shows timings (upper two stages) at which image data are generated in the image generation section 10, and timings (lower two stages) at which the image data are displayed in the display device 16. In the present embodiment, the update rate is one half of the display rate, and hence the same image is repeatedly displayed in the display device 16 two times.

In the present embodiment, the display output section 18 does not access to the image data storage section 12 at each of the two times, but stores the image data read from the image data storage section 12 in the temporary storage section 20, so as to repeatedly display the same image at the second display timing by using the image data stored in the temporary storage section 20. In the following, the operation of the display control device 1 will be described.

Figure 3A:
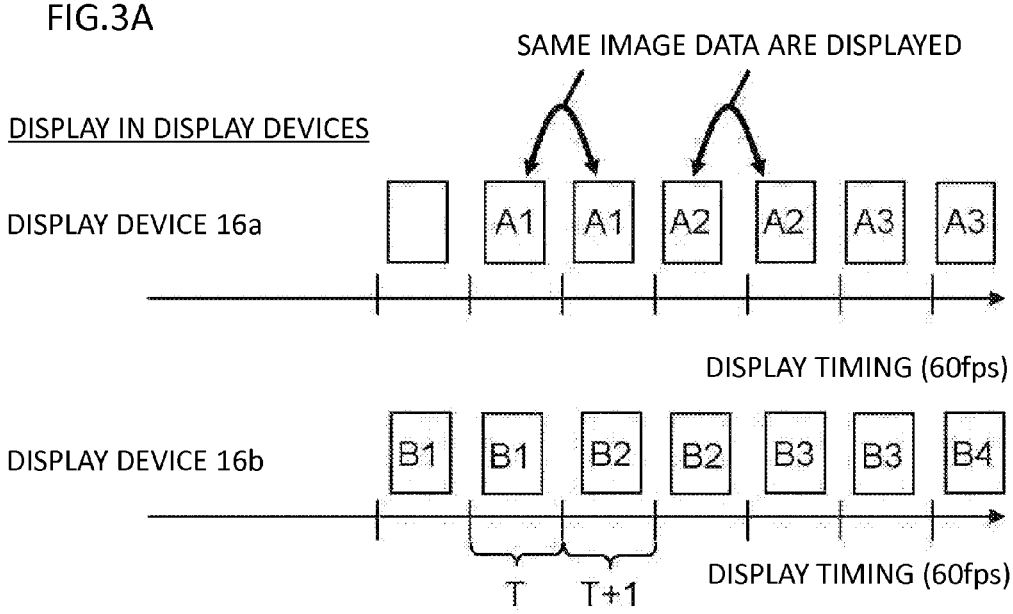
FIG. 3A shows timings at which image data are displayed in the respective display devices.

FIG. 3A shows timings at which image data are displayed in the respective display devices 16. In the following, the display of the image data at the timing T and the display of the image data at the timing T+1 will be described. At the timing T, the frame A1 is displayed in the display device 16*a*, and the frame B1 is displayed in the display device 16*b*. At the timing T+1, the frame A1 is displayed in the display device 16*a*, and the frame B2 is displayed in the display device 16*b*.

Figure 3B:
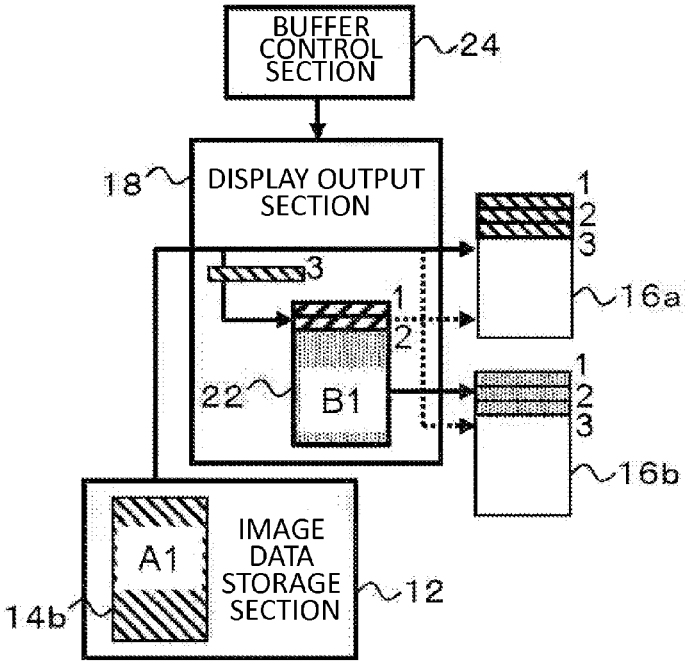
FIG. 3B shows a method for displaying the image data at timing T.

FIG. 3B shows a method for displaying the image data at the timing T. In FIG. 3B, the flow of image data is represented by solid lines. At the timing T, the display output section 18 reads the frame B1 from the frame buffer 22 of the temporary storage section 20, and displays the read frame B1 in the display device 16*b*. The display output section 18 reads the frame A1 from the image data storage section 12, and displays the read frame A1 in the display device 16*a*, and stores the read frame A1 in the temporary storage section 20.

At this time, the buffer control section 24 performs read and write control so that the frame B1 which is not read from the frame buffer 22 is not overwritten by the frame A1. Specifically, the buffer control section 24 reads the first line of the frame B1 to transmit the read line to the display device 16*b*, and thereafter stores the first line of the frame A1 in the frame buffer 22. Next, the buffer control section 24 reads the second line of the frame B1 to transmit the read line to the display device 16*b*, and thereafter stores the second line of the frame A1 in the frame buffer 22. Similarly, the buffer control section 24 stores the frame A1 in the region from which the frame B1 is read. Thereby, the buffer control section 24 performs control so that the portion of the frame B1, which portion is not yet read from the frame buffer 22, is not overwritten at the time when the frame A1 is stored in the frame buffer 22.

With the above processing, at the timing T, the frame A1 is displayed in the display device 16*a*, and the frame B1 is displayed in the display device 16*b*. At this time, the frame A1 is stored in the temporary storage section 20. As can be seen from the above description, the frame B1 is read from the temporary storage section 20 at the timing T, and is not read from the image data storage section 12.

Figure 3C:
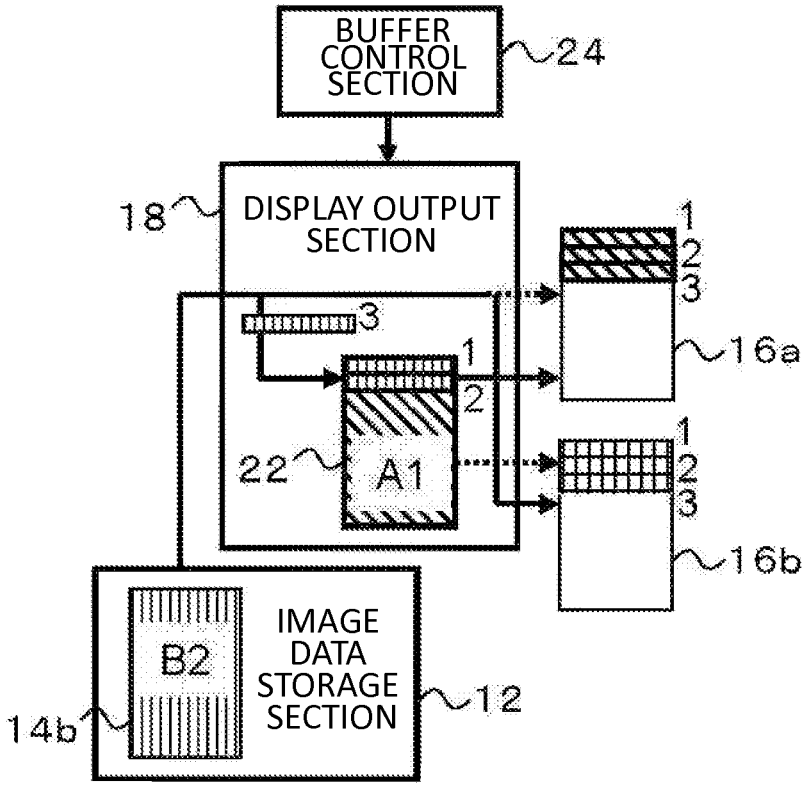
FIG. 3C shows a method for displaying the image data at timing T+1.

FIG. 3C shows a method for displaying the image data at the timing T+1. At the timing T+1, the display output section 18 reads the frame A1 from the frame buffer 22 of the temporary storage section 20 to display the read frame A1 in the display device 16*a*. The display output section 18 reads the frame B2 from the image data storage section 12 to display the read frame B2 in the display device 16*b*, and also stores the read frame B2 in the temporary storage section 20.

Also at this time, the buffer control section 24 performs the read and write control in the unit of one line so that the portion of the frame A1, which portion is not yet read from the frame buffer 22, is not overwritten by the frame B2. With this processing, at the timing T+1, the frame A1 is displayed in the display device 16*a* and the frame B2 is displayed in the display device 16*b*. At this time, the frame B2 is stored in the temporary storage section 20. As can be seen from the above description, the frame A1 is read from the temporary storage section 20 at the timing T+1, and is not read from the image data storage section 12.

In this way, the image data displayed in the display device 16*a* and the image data displayed in the display device 16*b* are alternately stored in the frame buffer 22. When the image data are supplied to the display device 16, the number of times of access to the image data storage section 12 can be reduced to one half by reading and transmitting the image data from both the image data storage section 12 and the frame buffer 22.

The display control device 1 according to the present embodiment is configured such that the need to access the image data storage section 12 each time the image data are displayed is eliminated by using the image data stored in the temporary storage section 20 provided in the internal memory. Thereby, it is possible to reduce the number of times of access to the image data storage section 12.

In the display control device 1 according to the present embodiment, the one frame buffer 22 provided in the temporary storage section 20 is commonly used as the region which stores the image data to be displayed in the display device 16*a* and the display device 16*b*. Thus, it is possible to reduce the capacity of the frame buffer 22 and to reduce an increase in the cost of the frame buffer 22.

In the above described embodiment, a case where the image data to be displayed in the display device 16*a* and the image data to be displayed the display device 16*b* are both updated at the same update rate of 30 fps in the image generation section 10 is described. However, the update rate may not necessarily be the same. For example, the update rate of the image data to be displayed in the display device 16*a* may be 30 fps, and the update rate of the image data to be displayed in the display device 16*b* may be 20 fps.

Figure 4:
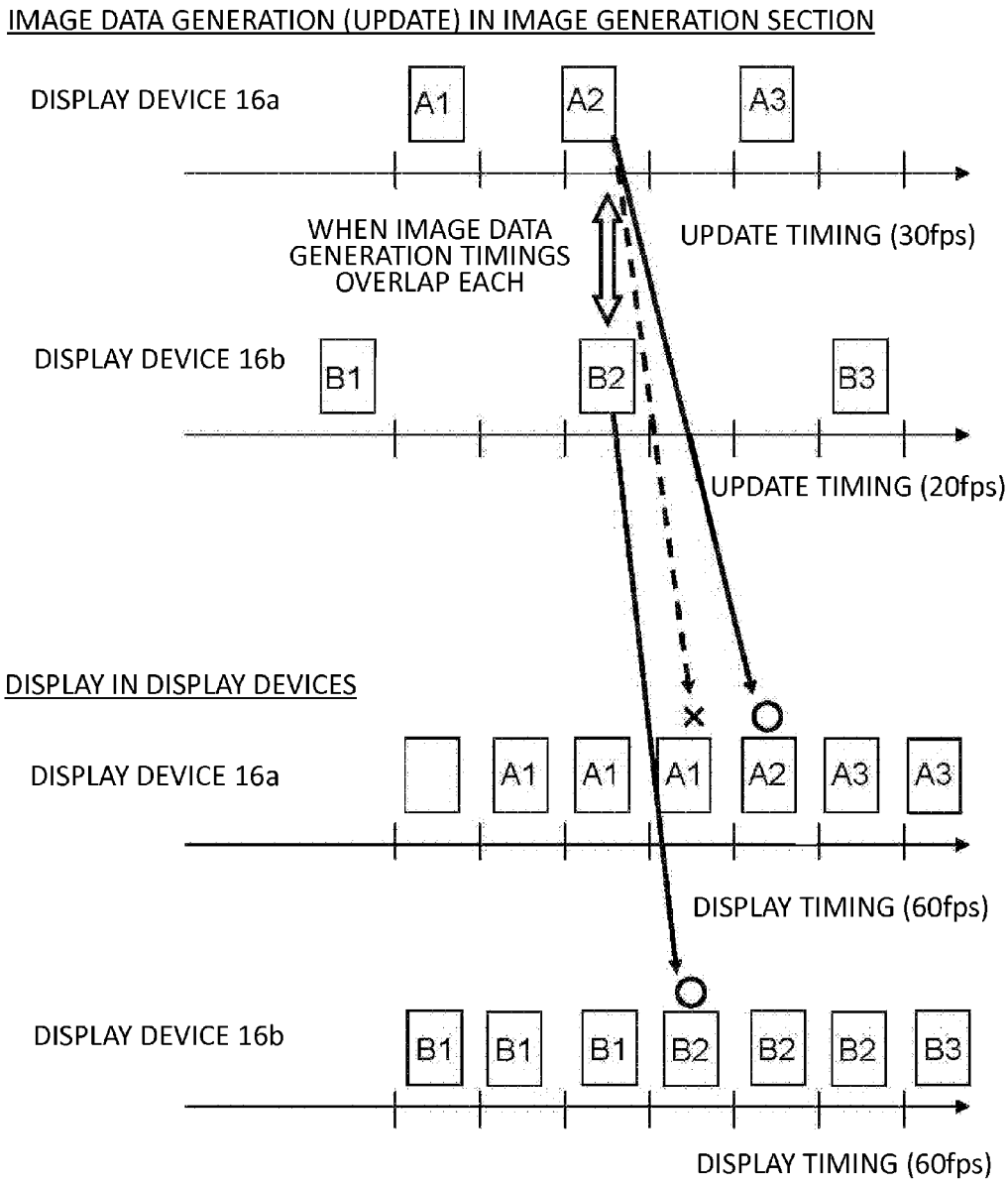
FIG. 4 shows timings at which image data are generated in the image generation section, and timings at which the image data are displayed in the display devices.

FIG. 4 shows timings at which image data are generated and displayed in the case where the update rates are different for each of the display devices in this way. When the update rates are different for each of the display devices, the generation timing of the image data to be displayed in the display device 16*a* may overlap the generation timing of the image to be displayed in the display device 16*b*. In this case, the display output section 18 reads the image data for one of the display devices from the image data storage section 12, and reads the image data for the other of the display devices from the frame buffer 22 of the temporary storage section 20. FIG. 4 shows an example in which image data A2 and image data B2 are generated at the same timing. The display output section 18 uses, as the image data to be displayed in the display device 16*a*, not the newly generated image data A2 but the image data A1 stored in the frame buffer 22 of the temporary storage section 20. The display output section 18 reads newly generated image data B2 from the image data storage section 12 and uses the read data as the image data to be displayed in display device 16*b*. In this way, when image data for the plurality of display devices are generated at the same time, the image data stored in the temporary storage section 20 are used as the image data for one of the image display devices, so that the processing can be suitably continued without generating any trouble.

Second Embodiment

Next, a display control device according to a second embodiment will be described. The basic configuration of the display control device according to the second embodiment is the same as the configuration of the display control device 1 according to the first embodiment. The second embodiment is different from the first embodiment in the processing performed in the case where the image data different from the preceding image data only in a partial region of the preceding image data are generated in the image generation section 10.

Figure 5A:
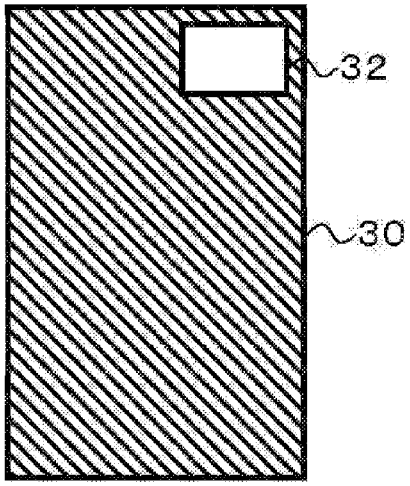
FIG. 5A shows an example of image data which are different from the preceding image data only in a partial region of the preceding image data.

FIG. 5A shows an example of image data 30 which are different from the preceding image data only in a partial region 32 of the image data 30. The image data different only in the partial region corresponds to, for example, a screen of a portable telephone, which screen is displayed in the case where the residual amount of battery and the antenna indicator value representing the radio wave intensity are changed.

Figure 5B:
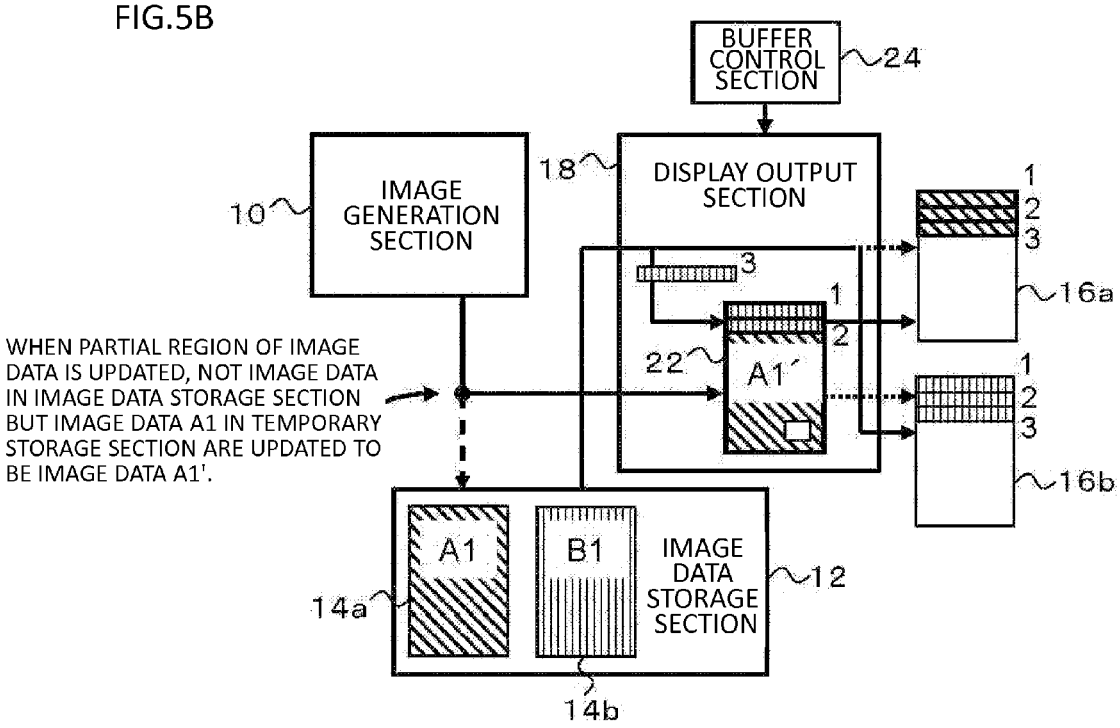
FIG. 5B shows an operation of the display control device at the time when the image data, which are different from the preceding image data only in the partial region of the preceding image data, are generated.
Figure 6:
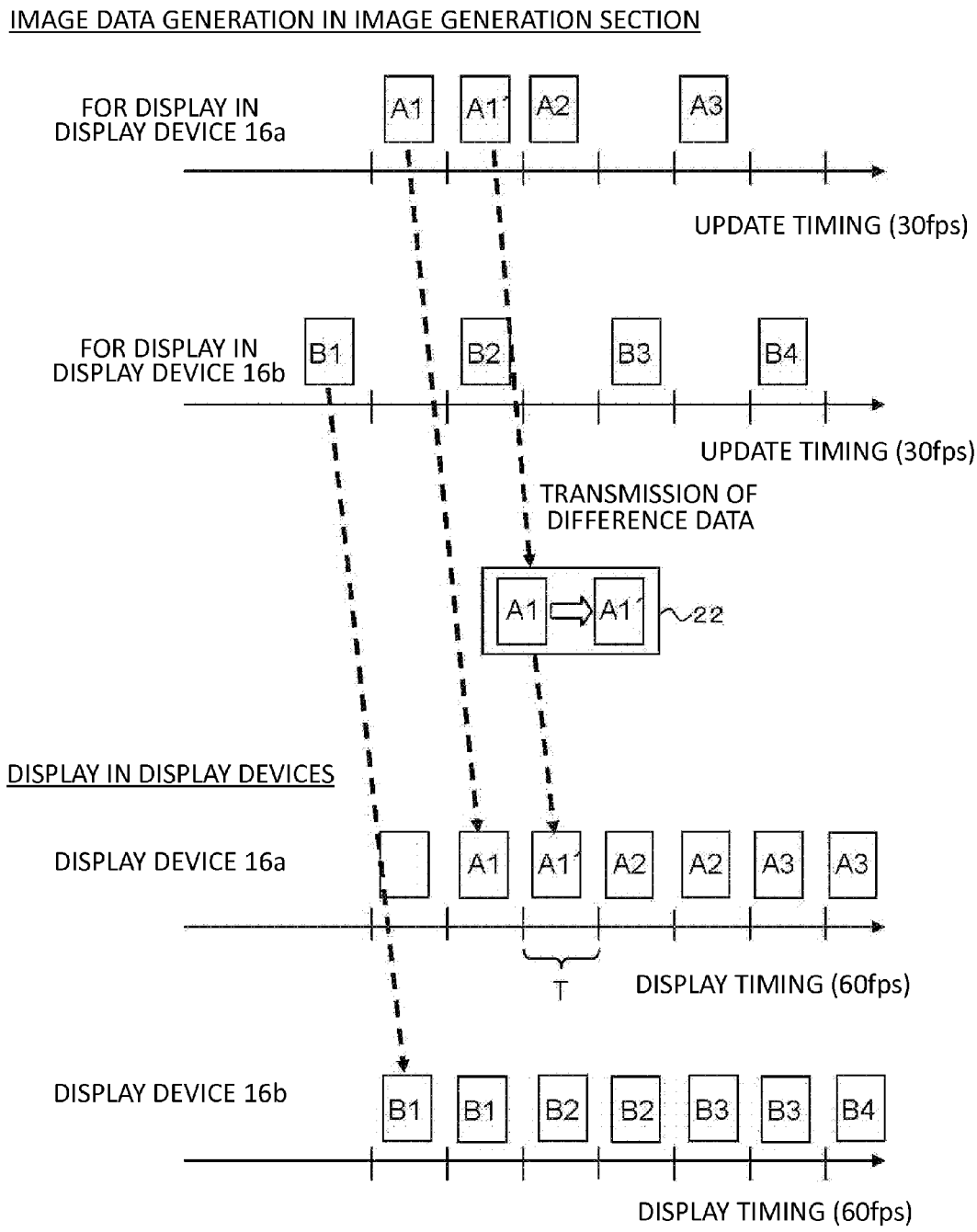
FIG. 6 shows timings at which image data are generated in the image generation section, and timings at which the image data are displayed in the display devices.

FIG. 5B shows an operation of the display control device 1 at the time when image data A1', which is different from image data A1 only in a partial region of the image data A1, is generated. FIG. 6 shows timings at which image data are generated in the image generation section 10, and timings at which the image data are displayed in the display device 16.

The display control device 1 according to the first embodiment stores the image data generated in the image generation section 10 in the frame buffers 14*a* and 14*b* of the image data storage section 12 regardless of whether the image data are different from the preceding frame image data only in a partial region or in all region of the preceding frame image data.

In the second embodiment, when the image generation section 10 determines that the generated image data A1' are different from the preceding frame image data A1 only in a partial region of the preceding frame image data A1, the image generation section 10 does not store the image data A1' in the image data storage section 12, but transmits the difference data between the generated image data A1' and the preceding frame image data A1 to the display output section 18. When receiving the difference data from the image generation section 10, the display output section 18 generates the image data A1' by using the received difference data and thereby changing the partial region of the image data A1 stored in the frame buffer 22 of the temporary storage section 20.

Thereafter, the display output section 18 reads the image data A1' from the temporary storage section 20, and transmits the read image data to the display device 16*a*. After reading the image data A1', the display output section 18 stores the image data B2 in the temporary storage section 20. With the above operation, it is possible to display an image which is different from the preceding image only in a partial region of the preceding image, without access to the image data storage section 12, and thereby it is possible to reduce the amount of access to the image data storage section 12.

In the above, the configuration and operation of the display control device according to the present invention have been described in detail by means of the embodiments, but the present invention is not limited to the above described embodiments.

In the above described embodiments, a case where the update rate of the image data displayed in the display device 16*a* is substantially equal to the update rate of the image data displayed in the display device 16*b* is described, but the embodiments can be applied to the case where the difference in the update rate is large. For example, in the case where a moving picture is displayed in the display device 16*a* and where an e-mail screen is displayed in the display device 16*b*, the e-mail screen is updated by manual input, and hence the update rate of the e-mail screen data is lower than the update rate of the moving picture. In such case, when the temporary storage section 20 is used as a dedicated frame buffer to store the image data with the lower update rate, the image data may be read from the image data storage section 12 only at the time when the display image is updated. Thus, it is possible to significantly reduce the number of times of access to the image data storage section 12. Note that the display output section 18 may have a configuration to monitor the update rate, or may estimate the update rate on the basis of the kinds of the application (for example, a moving picture, an e-mail screen, and the like).

Further, when the update rate of the image data is close to the display rate, the image data are frequently updated, and hence the image stored in the temporary storage section 20 cannot be displayed a plurality of times. In such case, it may also be configured such that the image data with the high update rate are not stored in the temporary storage section 20. Whether or not the update rate of image data is close to the display rate can be determined in such a manner that a threshold value for the determination is set beforehand, and that whether or not the update rate is equal to or higher than the threshold value is determined. When it is determined that the update rate of image data is higher than the threshold value, the display output section 18 does not perform the processing of storing the image data in the temporary storage section 20, but reads the image data from the image data storage section 12 in correspondence with the display rate.

In the above described embodiments, an example having a configuration, in which the image data are generated in the image generation section 10 and in which the generated image data are stored in the image data storage section 12, is described, but the present invention can also be applied to the display control device 1 which does not have the image generation section 10. That is, the present invention can also be applied to the case where image data stored beforehand are read and displayed.

In the above described embodiments, the display control device 1, which controls the image display in the plurality of display devices 16, is described, but the present invention can be applied to various information terminal apparatuses having a plurality of display devices 16.

In the above, preferred embodiments according to the present invention, which can be considered at present, are described. However, it is understood that various modifications of the embodiments are possible, and it is intended that such all modifications be included within the spirit and scope of the present invention.

INDUSTRIAL APPLICABILITY

A display control device according to the present invention has a plurality of display devices, and is useful, in general, for digital apparatuses having a problem in the memory band or power consumption.

The invention claimed is:

1. A display control device comprising:

a first display device;

a second display device;

a display output section which supplies image data to the first display device and the second display device;

an image data storage section which stores image data;

a temporary storage section which includes a frame buffer that temporarily stores image data read from the image data storage section; and a buffer control section which controls timings of writing and reading image data to and from the frame buffer, wherein at a first display timing, the display output section (i) reads first image data to be displayed in the first display device from the frame buffer so as to transmit the read first image data to the first display device, and (ii) reads second image data to be displayed in the second display device from the image data storage section so as to (a) transmit the read second image data to the second display device and (b) write the read second image data in the frame buffer, wherein at the first display timing, the buffer control section performs control to prevent a portion of the first image data which is stored in the frame buffer and which has not yet been read by the display output section from being overwritten by the second image data read from the image data storage section, wherein at a second display timing that is the display timing occurring immediately after the first display timing, the display output section (i) reads the second image data from the frame buffer, so as to transmit the read second image data to the second display device, and (ii) reads third image data to be displayed in the first display device from the image data storage section so as to (a) transmit the read third image data to the first display device and (b) write the third image data in the frame buffer, wherein at the second display timing, the buffer control section performs control to prevent a portion of the second image data which is stored in the frame buffer and which has not yet been read by the display output section from being overwritten by the third image data read from the image data storage section, wherein the display control device further comprises an image data generation section which generates image data to be displayed in one of the first display device or the second display device at an update rate lower than a display rate of the one of the first display device or the second display device, and which stores the generated image data in the image data storage section, wherein the image generation section comprises an update rate information acquisition section which acquires information about an update rate used to generate image data, wherein, when the display output section determines that the update rate of the image data generated in the image generation section is higher than a predetermined threshold value, the display output section transmits the image data to the first display device or the second display device from the image data storage section without writing the image data in the frame buffer, and wherein, when the display output section determines that the update rate of the image data generated in the image generation section is lower than a predetermined threshold value, the display output section sets the frame buffer as a dedicated frame buffer in which only the generated image data is written.

2. The display control device according to claim 1, wherein the buffer control section performs control of writing and reading image data to and from the frame buffer in the unit of each of the lines configuring the image data.

3. The display control device according to claim 1, wherein the buffer control section performs control of writing and reading image data to and from the frame buffer in the unit of each memory access to the frame buffer.

4. The display control device according to claim 1, wherein the display output section (i) reads the latest image data from the image data storage section at the timing of the latest image data is generated by the image data generation section so as to (a) transmit the read latest image data to the first display device or the second display device and (b) write the read latest image data in the frame buffer, and (ii) when an image data generating timing for image data to be displayed in the first display device and an image data generating timing for image data to be displayed in the second display device overlap each other, reads the image data to be displayed in the first display device from the image storage section at a current display timing, and reads the image data to be displayed in the second display device from the image storage section at a next display timing.

5. The display control device according to claim 1, wherein, when the image generation section generates image data in which a partial region of the preceding frame is updated, the image generation section does not transmit the generated image data to the image data storage section, but writes data representing the change in the partial region to the frame buffer.

6. An information processing terminal comprising:

a first display device;

a second display device;

a display output section which supplies image data to the first display device and the second display device;

an image data storage section which stores image data;

a temporary storage section which includes a frame buffer that temporarily stores image data read from the image data storage section; and a buffer control section which controls timings of writing and reading image data to and from the frame buffer, wherein the display output section (i) reads first image data to be displayed in the first display device from the frame buffer so as to transmit the read first image data to the first display device, and (ii) reads second image data to be displayed in the second display device from the image data storage section so as to (a) transmit the read second image data to the second display device and (b) write the read second image data in the frame buffer, wherein the buffer control section performs control to prevent a portion of the first image data which is stored in the frame buffer and which has not yet been read by the display output section from being overwritten by the second image data read from the image data storage section, wherein the information processing terminal further comprises an image data generation section which generates image data to be displayed in one of the first display device or the second display device at an update rate lower than a display rate of the one of the first display device or the second display device, and which stores the generated image data in the image data storage section, wherein the image generation section comprises an update rate information acquisition section which acquires information about an update rate used to generate image data, wherein, when the display output section determines that the update rate of the image data generated in the image generation section is higher than a predetermined threshold value, the display output section transmits the image data to the first display device or the second display device from the image data storage section without writing the image data in the frame buffer, and wherein, when the display output section determines that the update rate of the image data generated in the image generation section is lower than a predetermined threshold value, the display output section sets the frame buffer as a dedicated frame buffer in which only the generated image data is written.

7. A display control method for a display control device, the display control device including:

a first display device;

a second display device;

a display output section which supplies image data to the first display device and the second display device;

an image data storage section which stores image data;

a temporary storage section which includes a frame buffer that temporarily stores image data read from the image data storage section; and a buffer control section which controls timings of writing and reading image data to and from the frame buffer, the display control method comprising:

reading, at a first display timing and using the display output section, first image data to be displayed in the first display device from the frame buffer and transmitting the read first image data to the first display device;

reading, at the first display timing and using the display output section, second image data to be displayed in the second display device from the image data storage section, transmitting the read second image data to the second display device, and writing the read second image data in the frame buffer;

performing, at the first display timing and using the buffer control section, control to prevent a portion of the first image data which is stored in the frame buffer and which has not yet been read by the display output section from being overwritten by the second image data read from the image data storage section;

reading, at a second display timing that is the display timing occurring immediately after the first display timing and using the display output section, the second image data from the frame buffer, and transmitting the read second image data to the second display device;

reading, at the second display timing and using the display output section, third image data to be displayed in the first display device from the image data storage section, transmitting the read third image data to the first display device, and writing the third image data in the frame buffer; and performing, at the second display timing and using the buffer control section, control to prevent a portion of the second image data which is stored in the frame buffer and which has not yet been read by the display output section from being overwritten by the third image data read from the image data storage section, wherein the display control device further comprises an image data generation section which generates the image data to be displayed in the display devices at an update rate lower than the display rate of the display devices, and which stores the generated image in the image data storage section, wherein the image generation section comprises an update rate information acquisition section which acquires information about an update rate used to generate image data, wherein, when the display output section determines that the update rate of the image data generated in the image generation section is higher than a predetermined threshold value, the display output section transmits the image data to the display devices from the image data storage section without writing the image data in the frame buffer, and wherein, when the display output section determines that the update rate of the image data generated in the image generation section is lower than a predetermined threshold value, the display output section sets the frame buffer as a dedicated frame buffer in which only the generated image data is written.

8. A display control device comprising:

a plurality of display devices;

a display output section which supplies image data to be displayed in the display devices;

an image data storage section which stores the image data;

a temporary storage section which temporarily stores image data read from the image data storage section and which has a number of frame buffers, the number of frame buffers being less than the number of the display devices; and a buffer control section which controls timings of writing and reading image data to and from the frame buffer, wherein the display output section (i) reads first image data from the frame buffers on the basis of a control signal from the buffer control section, so as to transmit the read first image data to predetermined display devices among the plurality of display devices, and (ii) reads second image data to be displayed in the remaining display devices from the image data storage section, so as to (i) transmit the read second image data to the remaining display devices and (ii) write the read second image data in the frame buffer on the basis of the control signal from the buffer control section, wherein the buffer control section performs control so as to prevent that the first image data, which is stored in the frame buffer and which is not yet read, is overwritten by the second image data read from the image data storage section, wherein the buffer control section performs control of writing and reading image data to and from the frame buffers in the unit of each of the lines configuring the image data, wherein the buffer control section performs control of writing and reading image data to and from the frame buffers in the unit of each memory access to the frame buffers, wherein the display control device further comprises an image data generation section which generates the image data to be displayed in the display devices at an update rate lower than the display rate of the display devices, and which stores the generated image in the image data storage section, wherein the display output section (i) reads the latest image data from the image data storage section at the timing of the latest image data is generated by the image data generation section, so as to transmit the read latest image data to the predetermined display devices or the remaining display devices and to write the read latest image data in the frame buffers, and (ii) when an image data generating timing for image data to be displayed in the predetermined display devices and an image data generating timing for image data to be displayed in the remaining display devices overlap each other, reads the image data to be displayed in the predetermined display devices from the image storage section at a current display timing, and reads the image data to be displayed in the remaining display devices from the image storage section at a next display timing, wherein the image generation section comprises an update rate information acquisition section which acquires information about an update rate used to generate image data, wherein, when the display output section determines that the update rate of the image data generated in the image generation section is higher than a predetermined threshold value, the display output section transmits the image data to the display devices from the image data storage section without writing the image data in the frame buffer, and wherein, when the display output section determines that the update rate of the image data generated in the image generation section is lower than a predetermined threshold value, the display output section sets the frame buffer as a dedicated frame buffer in which only the generated image data is written.

9. A display control method for a display control device, the display control device including:

a plurality of display devices;

a display output section which supplies image data to be displayed in the display devices;

an image data storage section which stores the image data;

a temporary storage section which temporarily stores image data read from the image data storage section and which has a number of frame buffers, the number of frame buffers being less than the number of the display devices; and a buffer control section which controls timings of writing and reading image data to and from the frame buffer, the display control method comprising:

reading, using the display output section, the first image data from the frame buffers on the basis of a control signal from the buffer control section and transmitting the read first image data to predetermined display devices among the plurality of display devices;

reading, using the display output section, second image data to be displayed in the remaining display devices from the image data storage section, transmitting the read second image data to the remaining display devices, and writing the read second image data in the frame buffer on the basis of the control signal from the buffer control section; and performing control, using the buffer control section, so as to prevent that the first image data, which is stored in the frame buffer and which is not yet read, is overwritten by the second image data read from the image data storage section, wherein the buffer control section performs control of writing and reading image data to and from the frame buffers in the unit of each of the lines configuring the image data, wherein the buffer control section performs control of writing and reading image data to and from the frame buffers in the unit of each memory access to the frame buffers, wherein the display control device further comprises an image data generation section which generates the image data to be displayed in the display devices at an update rate lower than the display rate of the display devices, and which stores the generated image in the image data storage section, wherein in said reading the first image data or said reading the second image data, the display output section, reads the latest image data from the image data storage section at the timing of the latest image data is generated by the image data generation section, transmits the read latest image data to the predetermined display devices or the remaining display devices, and writes the read latest image data in the frame buffers, wherein when an image data generating timing for image data to be displayed in the predetermined display devices and an image data generating timing for image data to be displayed in the remaining display devices overlap each other, the display output section reads the image data to be displayed in the predetermined display devices from the image storage section at a current display timing, and reads the image data to be displayed in the remaining display devices from the image storage section at a next display timing, wherein the image generation section comprises an update rate information acquisition section which acquires information about an update rate used to generate image data, wherein, when the display output section determines that the update rate of the image data generated in the image generation section is higher than a predetermined threshold value, the display output section transmits the image data to the display devices from the image data storage section without writing the image data in the frame buffer, and wherein, when the display output section determines that the update rate of the image data generated in the image generation section is lower than a predetermined threshold value, the display output section sets the frame buffer as a dedicated frame buffer in which only the generated image data is written.

* * * * *